US008453949B2

(12) United States Patent
Kwon

(10) Patent No.: US 8,453,949 B2
(45) Date of Patent: Jun. 4, 2013

(54) MULTI-COLOR PAINT APPLICATION APPARATUS

(76) Inventor: Jeong Oh Kwon, Seoul (KR)

( * ) Notice: Subject to any disclaimer, the term of this patent is extended or adjusted under 35 U.S.C. 154(b) by 495 days.

(21) Appl. No.: 12/742,251

(22) PCT Filed: Sep. 22, 2008

(86) PCT No.: PCT/KR2008/005642

§ 371 (c)(1),
(2), (4) Date: May 10, 2010

(87) PCT Pub. No.: WO2009/061074

PCT Pub. Date: May 14, 2009

(65) Prior Publication Data

US 2010/0270394 A1 Oct. 28, 2010

(30) Foreign Application Priority Data

Nov. 9, 2007 (KR) ..... 10-2007-0114274
Feb. 15, 2008 (KR) ..... 10-2008-0013958

(51) Int. Cl.
*A62C 13/66* (2006.01)

(52) U.S. Cl.
USPC ..... 239/305; 239/74; 239/307; 239/373

(58) Field of Classification Search
USPC ..... 239/303–305, 307, 373, 72, 74
See application file for complete search history.

(56) References Cited

U.S. PATENT DOCUMENTS 4,163,523 A 8/1979 Vincent
4,796,017 A * 1/1989 Merenda ..... 340/620
4,848,988 A * 7/1989 Suzuki ..... 55/315.2
5,085,169 A 2/1992 Okuda et al.
2002/0050247 A1 5/2002 Sekiguchi et al.

FOREIGN PATENT DOCUMENTS

KR 1019990033270 5/1999
KR 100707295 4/2007
KR 1020070084619 8/2007

OTHER PUBLICATIONS

International Search Report for PCT/KR2008/005642 mailed Apr. 9, 2009.

* cited by examiner

*Primary Examiner* — Jason Boeckmann
(74) *Attorney, Agent, or Firm* — Christopher Paul Mitchell

(57) ABSTRACT

Provided is a multi-color paint application apparatus, which includes: a paint storage portion having a number of paint containers in the inside of a storage body; a cover portion that can open and close the upper side of the storage body of the paint storage portion; a discharge portion which includes discharge tubes, and auxiliary containers paint discharge valves; a sensor portion having sensors which are respectively fixed to the discharge tubes, in which an alarm sound is produced by a buzzer if electric power is short-circuited; an air inlet portion including a 3-way valve which makes pressure of air selectively flow into the center of the cover portion; a dehumidification portion which is connected with an expansion tube where a drain plug that can remove moisture by adiabatic expansion of the compressed air is formed with the 3-way valve in the air inlet portion; and a spray gun which can selectively spray the compressed air through a switch formed in a handle lever.

8 Claims, 8 Drawing Sheets

[Fig. 1]
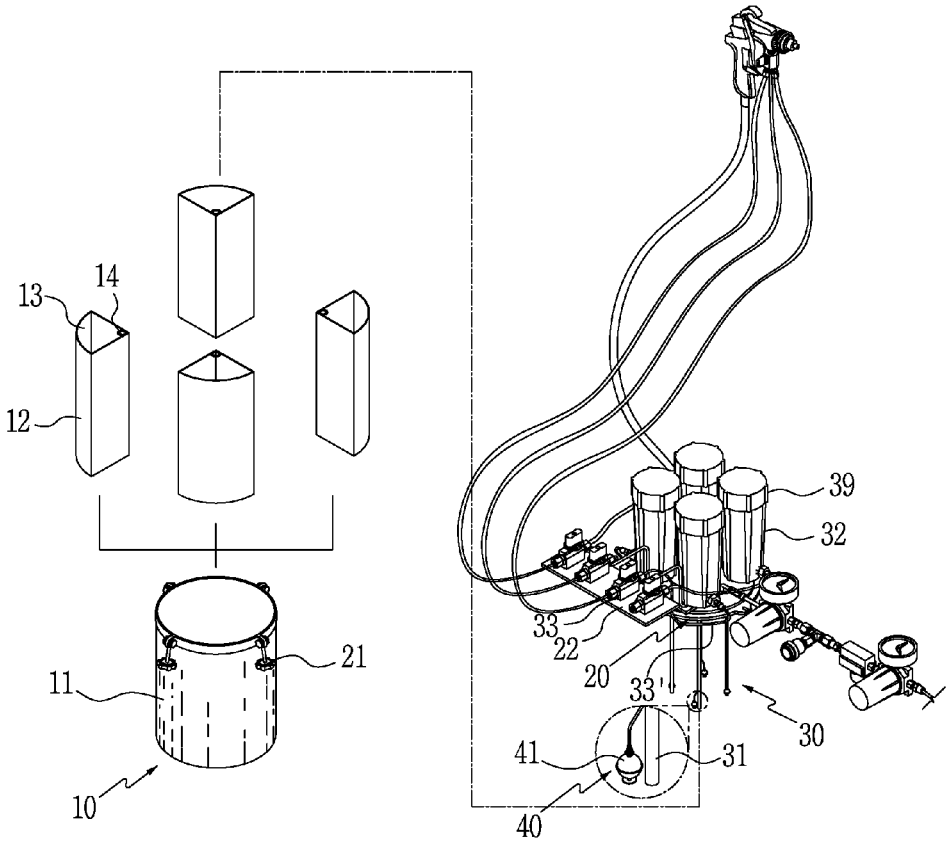

[Fig. 2]
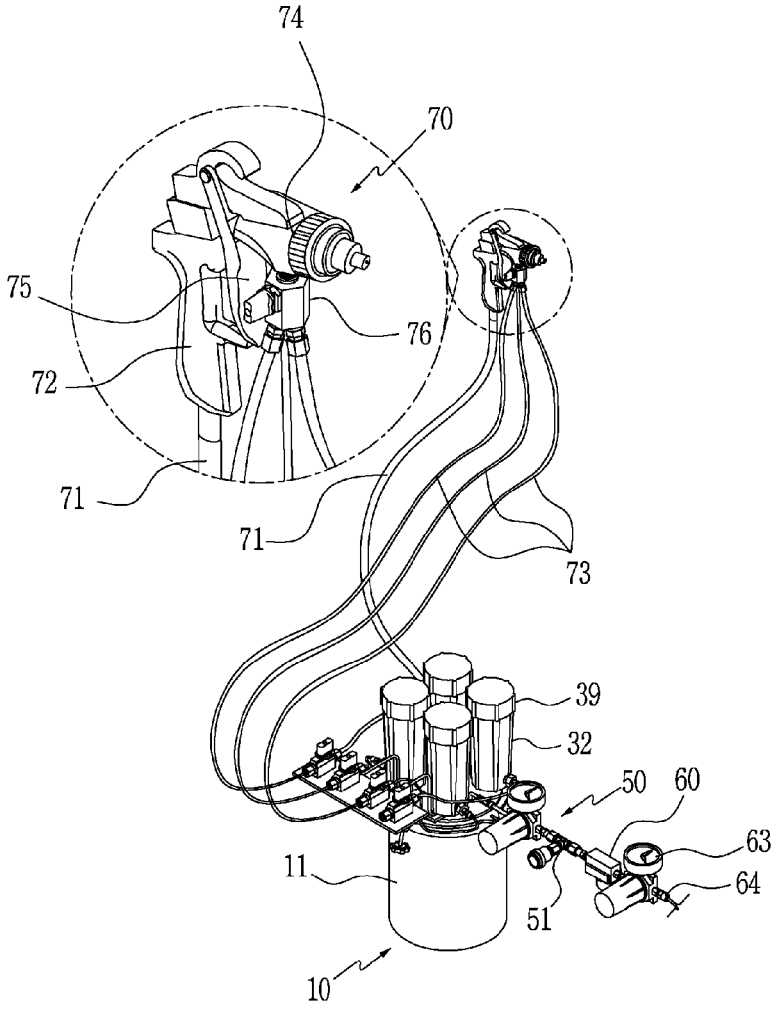
[Fig. 3]
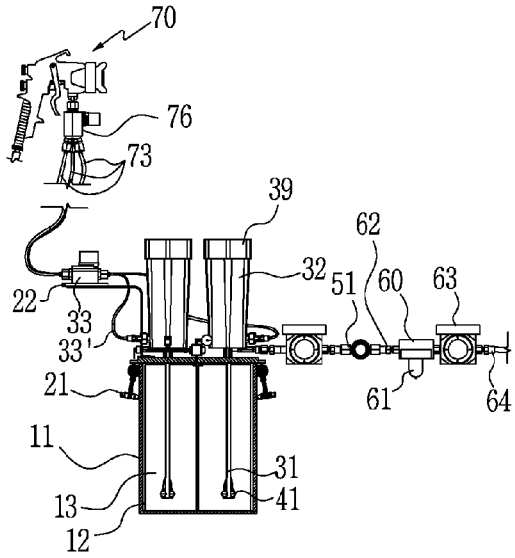

[Fig. 4]
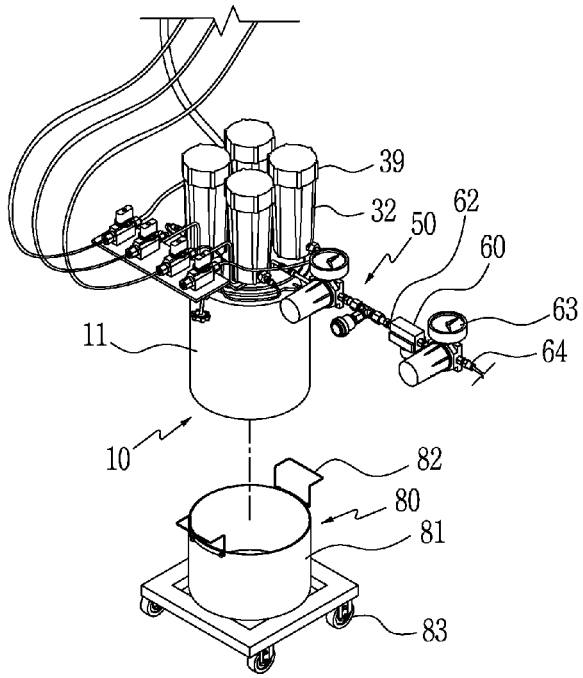
[Fig. 5]
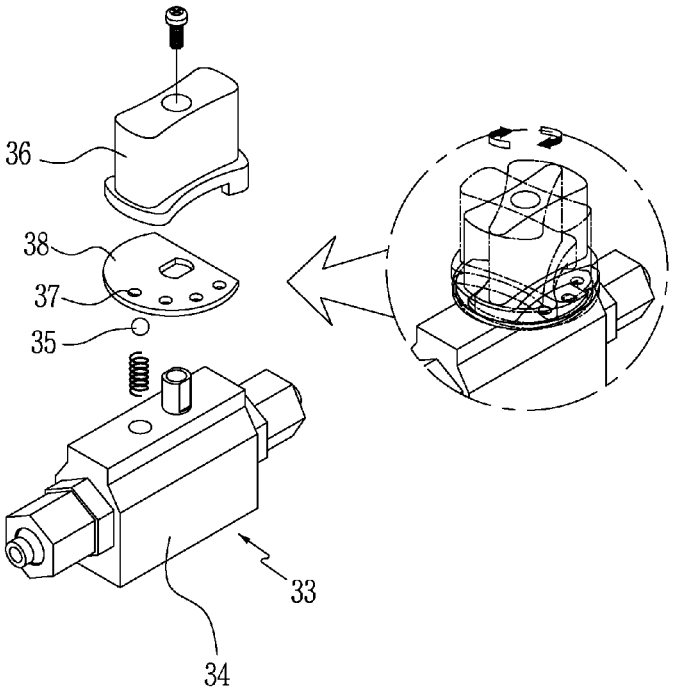

[Fig. 6]
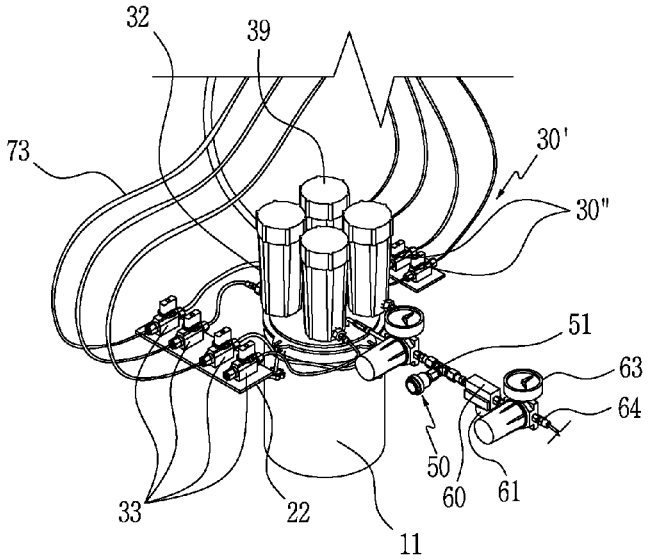
[Fig. 7]
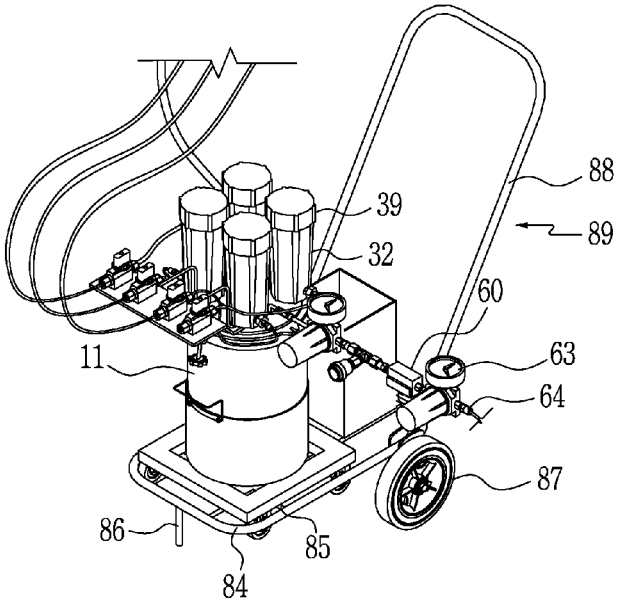

[Fig. 8]
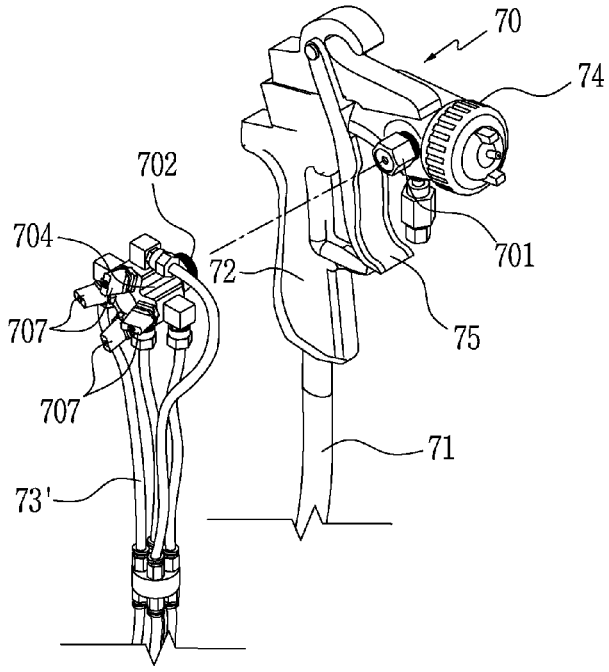
[Fig. 9]
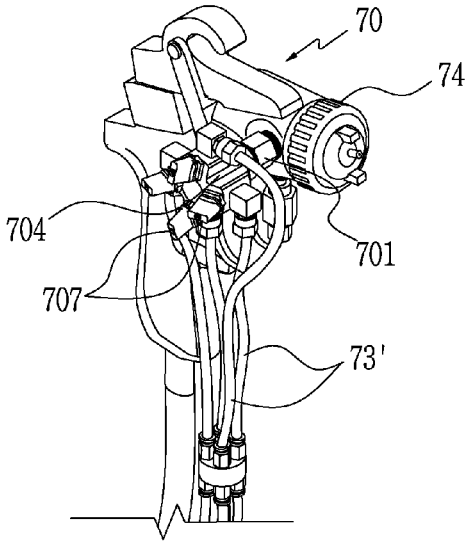

[Fig. 10]
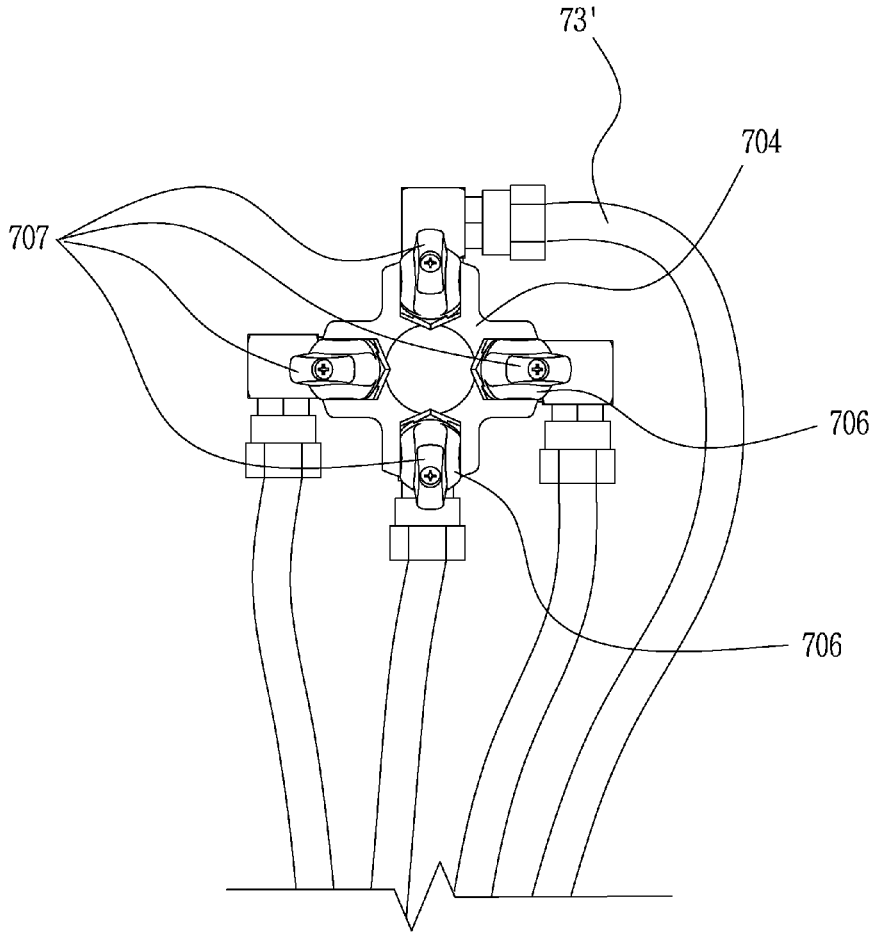
[Fig. 11]
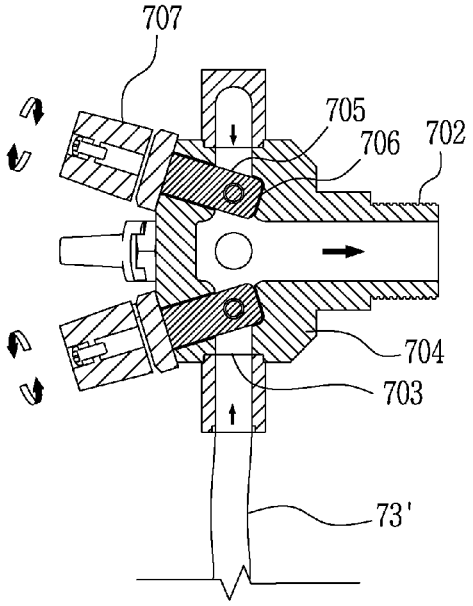

[Fig. 12]
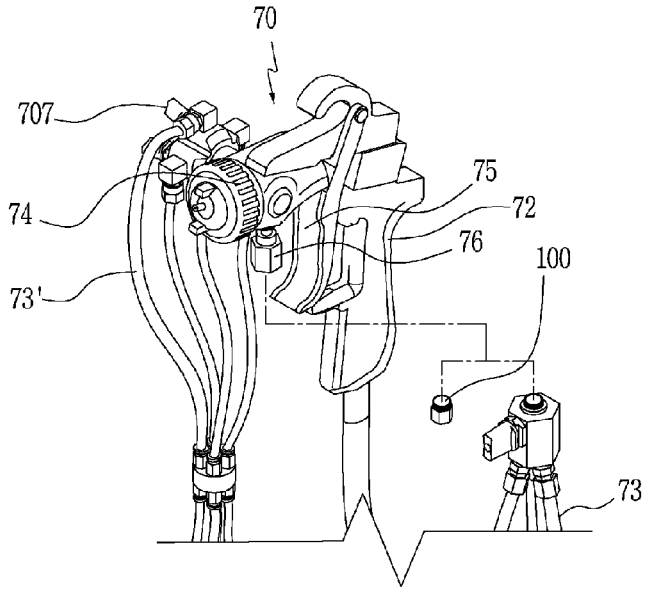
[Fig. 13]
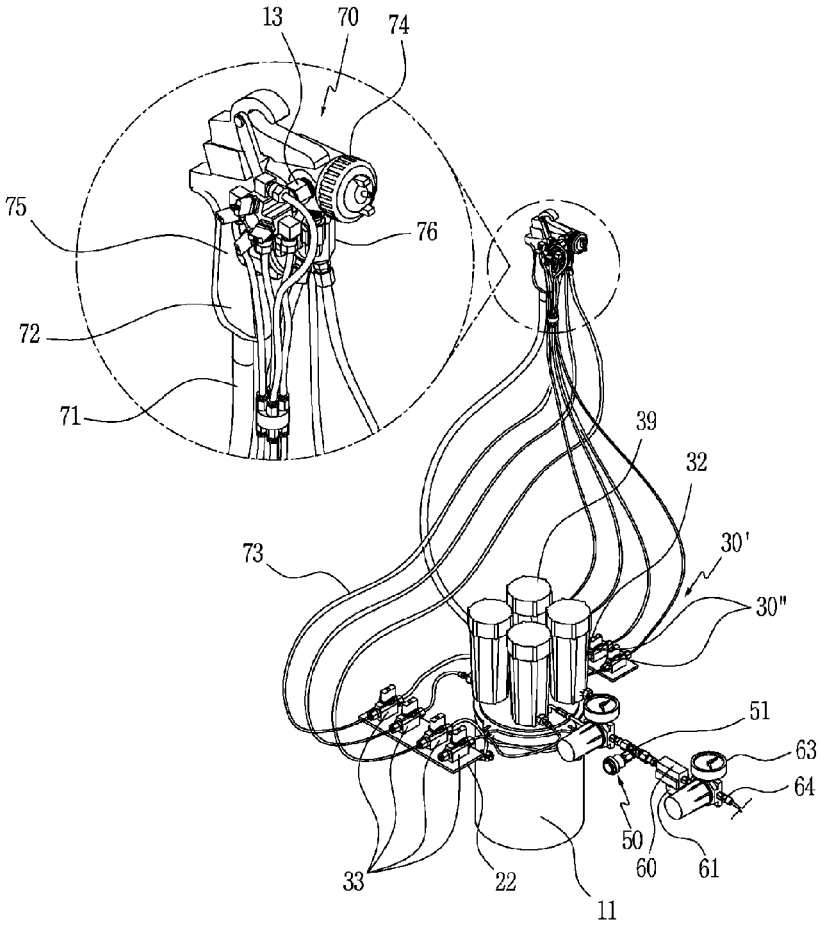

[Fig. 14]
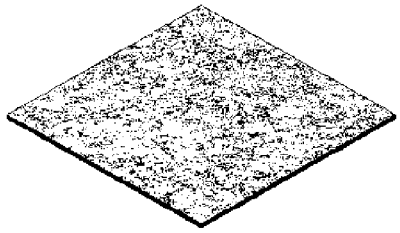
[Fig. 15]
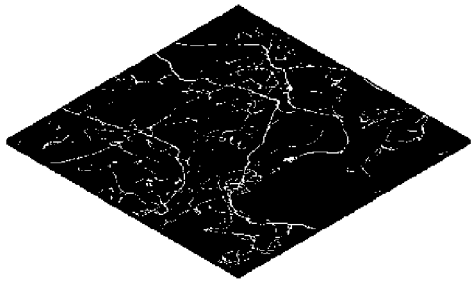
[Fig. 16]
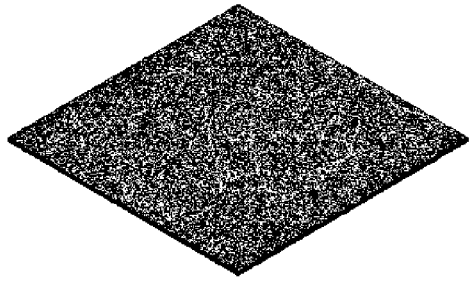
[Fig. 17]
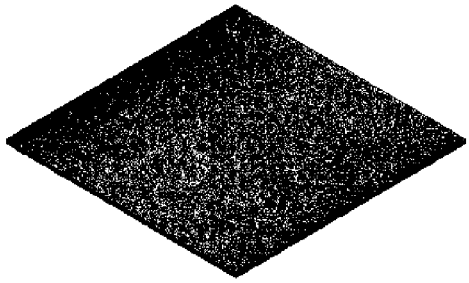
[Fig. 18]
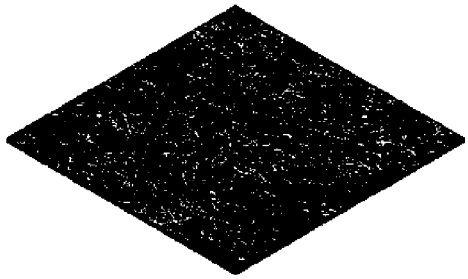

MULTI-COLOR PAINT APPLICATION APPARATUS

RELATED APPLICATIONS

This application is a 371 application of International Application No. PCT/KR2008/005642, filed Sep. 22, 2008, which in turn claims priority from Korean Patent Application Nos. 10-2008-0013958, filed Feb. 15, 2008, and 10-2007-0114274, filed Nov. 9, 2007, all of which are incorporated herein by reference in their entireties.

TECHNICAL FIELD

The present invention relates to a multi-color paint application (or coating) apparatus, and more particularly, to a multi-color paint application apparatus which applies multi-color paints through a single spray gun in order to give texture of marble, in which an amount of each paint of multi-color paints which are applied through the spray gun can be easily controlled during application, it is convenient to put each color paint into the application apparatus, and shortage of each color paint that is stored in the application apparatus can be informed to a user through a buzzer.

BACKGROUND ART

In general, in the case of paint application, a spray gun is used to spread paint on a wide extent or to obtain a gradation effect, and is also used to spread paints of various colors.

Compressed air which is generated from a separate compressor through an air tube is used for the paint application using the spray gun.

That is, a paint application apparatus has the above-described spray gun using a single gun housing with which a paint container containing one color paint is combined. Accordingly, there is no problem when a monochromatic paint is applied, but there is a problem that the single spray gun is washed and then used when multi-color paints are mixed and applied, to thereby lower workability. Further, when a number of spray guns are used, in order to apply multi-color paints, a number of paint workers should use the number of the spray guns. Accordingly, a number of skilled paint workers are needed, and a number of spray guns should be purchased.

In order to take into account the above-described problems, the applicant proposed a paint application apparatus having a spray gun which is disclosed in the Korean Patent Registration No. 707295.

The paint application apparatus having the above-described spray gun performs a paint application work of various colors of paints through a single spray gun in order to give texture of marble, to thus improve workability. In addition, since respectively different spray guns should not be used according to various paint colors, it is easy to install and dismantle the spray gun for paint application and it is convenient to wash the spray gun. However, it is difficult to carry the paint application apparatus, it is not possible to control an amount of each color paint, and it is inconvenient to open a cover for the whole paint application apparatus, in order to put each color paint into the paint application apparatus.

Further, it is not possible to identify a residual quantity of each paint container that is built in the paint application apparatus and it is also hard to withdraw the paint container from the paint application apparatus. Moisture included in the compressed air is not removed. Thus, moisture which is included in the sprayed paint may raise a defective rate in a paint application work.

DISCLOSURE OF INVENTION

Technical Problem

Therefore, in order to supplement the shortcoming of the conventional art, it is an object of the present invention to provide a multi-color paint application apparatus which controls an amount of each paint of multi-color paints sprayed through a spray gun, freely according to each color, to thus make even a beginner display various colors, makes it convenient to put each color paint into the multi-color paint application apparatus, according to colors, informs a user of shortage of each color paint through a buzzer, and removes moisture at inflow of compressed air, to thereby reduce a defective rate.

Technical Solution

To accomplish the above object of the present invention, there is provided a multi-color paint application apparatus comprising:

a paint storage portion having a number of paint containers in the inside of a storage body;

a cover portion that can open and close the upper side of the storage body of the paint storage portion, in which a fixing board which is bent to one side of the fixing body is fixed on the upper surface of the cover portion and fastening rings are formed around the upper edge of the storage body, to thereby make the storage body sealingly closed when the fastening rings are rotated;

a discharge portion which comprises discharge tubes which are penetratively formed on the upper surface of the cover portion and which are communicated with the number of paint containers, auxiliary containers which are provided on the upper portion of the discharge tubes and store respective paints discharged through the discharge tubes, and paint discharge valves that are fixed to the fixing board at the outside of the auxiliary container in which the paint discharge valves are connected with the discharge tubes through connection tubes;

a sensor portion having sensors which are respectively fixed to the discharge tubes in the discharge portion and whose contacts are short-circuited if a paint level is fallen in the paint containers, in which an alarm sound is produced by a buzzer if electric power is short-circuited;

an air inlet portion including a 3-way valve which makes pressure of air selectively flow into the center of the cover portion so that compressed air flows into the paint storage portion in order to discharge paint to a number of paint discharge valves via a connection tube which connects the discharge tubes in the discharge portion with the paint discharge valves in which the discharge portion communicates with the paint containers where the sensors of the sensor portion are built in;

a dehumidification portion which is connected with an expansion tube where a drain plug that can remove moisture by adiabatic expansion of the compressed air is formed with the 3-way valve in the air inlet portion, in which a connection valve where a pressure gauge is formed is connected with the expansion tube; and a spray gun which can selectively spray the compressed air through a switch formed in a handle lever, by connecting a compressed air inlet tube with the 3-way valve in the air inlet portion connected with the dehumidification portion to then be connected to the handle lever, and by connecting a nozzle and a connector with respective paint discharge tubes in the number of paint discharge valves.

Preferably but not necessarily, the multi-color paint application apparatus further comprises a carriage unit which comprises an accommodation body that can accommodate the body of the paint storage portion in the upper portion of the carriage unit, a body grip which is formed at both sides of the accommodation body, and a carrier caster which is formed at the lower portion of the carriage unit.

Preferably but not necessarily, the paint containers comprise a locker ring, respectively, at one side of an upper opening portion.

Preferably but not necessarily, the paint discharge valves in the discharge portion comprises: a stop ball which is elasticity installed in a valve body to properly control an amount of paint to be discharged; a control grip which is inserted into the valve body to then rotate so that the stop ball is inserted into and withdrawn from a number of stop holes; and a control plate in which the number of stop holes are formed and which is located at the lower portion of the control grip.

Preferably but not necessarily, a spiral stopper is formed at the upper portion of the auxiliary containers in the discharge portion, respectively.

Preferably but not necessarily, the multi-color paint application apparatus further comprises a carrier in which a loading plate is horizontally formed in a loading stand so that a carrier caster of the carriage unit is inserted to thus load the accommodation body, a support rod is formed in the lower-front end of the carriage unit, a moving wheel is axially installed in the lower-rear end of the loading stand, and a moving handle is installed at the upper-rear end of the carriage unit.

Preferably but not necessarily, the multi-color paint application apparatus further comprises a second discharge portion having second paint discharge valves which respectively communicate with the number of paint containers which are located at the opposite side of the discharge portion formed in the cover portion.

Preferably but not necessarily, the multi-color paint application apparatus further comprises a connection body which is formed in and engaged with a second connector which is formed at one side of the nozzle of the spray gun, in which a combiner is formed at one side of the outside of the connection body and a connection path is formed in the inner portion of the connection body so as to communicate with the nozzle, a valve body having a valve tube is inserted in order to open and close the connection path, a rotary handle is formed at the end of the valve body, and the second paint discharge valves in the second discharge portion and a second paint discharge tube are connected with each other in order to supply each color paint by rotation of the valve body.

Advantageous Effects

As described above, a multi-color paint application apparatus according to the present invention controls an amount of each paint of multi-color paints sprayed through a spray gun, freely according to each color, to thus provide an effect of making even a beginner display various colors, makes it convenient to put each color paint into the multi-color paint application apparatus, according to colors, informs a user of shortage of each color paint through a buzzer, and removes moisture at inflow of compressed air, to thereby provide an effect of reducing a defective rate.

As another effect of the present invention, an amount of paint can be easily controlled during spraying paint through a spray gun. Accordingly, at the time of application of paint, colors can be changed immediately.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

BRIEF DESCRIPTION OF THE DRAWINGS

FIG. 1 is a disassembled perspective view showing a multi-color paint application apparatus according to an embodiment of the present invention;

FIG. 2 is perspective view showing a multi-color paint application apparatus according to an embodiment of the present invention;

FIG. 3 is a cross-sectional view showing a multi-color paint application apparatus according to an embodiment of the present invention;

FIG. 4 is a disassembled perspective view showing a state where a carrier is applied in a multi-color paint application apparatus according to an embodiment of the present invention;

FIG. 5 is an enlarged perspective view showing a discharge valve of a multi-color paint application apparatus according to an embodiment of the present invention;

FIG. 6 is perspective view showing a multi-color paint application apparatus according to another embodiment of the present invention;

FIG. 7 is a perspective view showing another example of a carrier for carrying a multi-color paint application apparatus according to the present invention;

FIG. 8 is a perspective view showing another example of a spray gun in a multi-color paint application apparatus according to the present invention;

FIG. 9 is an assembled perspective view of FIG. 8;

FIG. 10 is a front view of FIG. 8;

FIG. 11 is a cross-sectional view of a connection body of FIG. 8;

FIG. 12 is a disassembled perspective view showing a state where the spray gun of FIG. 8 has been employed;

FIG. 13 is a perspective view showing a state of using the spray gun of FIG. 8; and FIGS. 14 to 18 are perspective views showing respective states where various colors are applied using the multi-color paint application apparatus according to the present invention.

BEST MODE FOR CARRYING OUT THE INVENTION

The present invention provides a multi-color paint application apparatus comprising: a paint storage portion having a number of paint containers in the inside of a storage body; a cover portion that can open and close the upper side of the storage body of the paint storage portion, in which a fixing board which is bent to one side of the fixing body is fixed on the upper surface of the cover portion and fastening rings are formed around the upper edge of the storage body, to thereby make the storage body sealingly closed when the fastening rings are rotated; a discharge portion which comprises discharge tubes which are penetratively formed on the upper surface of the cover portion and which are communicated with the number of paint containers, auxiliary containers which are provided on the upper portion of the discharge tubes and store respective paints discharged through the discharge tubes, and paint discharge valves that are fixed to the fixing board at the outside of the auxiliary container in which the paint discharge valves are connected with the discharge tubes through connection tubes; a sensor portion having sensors which are respectively fixed to the discharge tubes in the discharge portion and whose contacts are short-circuited if a paint level is fallen in the paint containers, in which an alarm sound is produced by a buzzer if electric power is short-circuited; an air inlet portion including a 3-way valve which makes pressure of air selectively flow into the center of the cover portion so that compressed air flows into the paint storage portion in order to discharge paint to a number of paint discharge valves via a connection tube which connects the discharge tubes in the discharge portion with the paint discharge valves in which the discharge portion communicates with the paint containers where the sensors of the sensor portion are built in; a dehumidification portion which is connected with an expansion tube where a drain plug that can remove moisture by adiabatic expansion of the compressed air is formed with the 3-way valve in the air inlet portion, in which a connection valve where a pressure gauge is formed is connected with the expansion tube; and a spray gun which can selectively spray the compressed air through a switch formed in a handle lever, by connecting a compressed air inlet tube with the 3-way valve in the air inlet portion connected with the dehumidification portion to then be connected to the handle lever, and by connecting a nozzle and a connector with respective paint discharge tubes in the number of paint discharge valves.

MODE FOR THE INVENTION

Hereinbelow, a multi-color paint application apparatus according to a respective preferred embodiment of the present invention will be described in more detail with reference to the accompanying drawings.

FIG. 1 is a disassembled perspective view showing a multi-color paint application apparatus according to an embodiment of the present invention. FIG. 2 is perspective view showing a multi-color paint application apparatus according to an embodiment of the present invention. FIG. 3 is a cross-sectional view showing a multi-color paint application apparatus according to an embodiment of the present invention.

As illustrated, a multi-color paint application apparatus according to the present invention includes a paint storage portion 10 which can contain paints by colors. For this purpose, the inside of a storage body 11 is partitioned so as to store a number of paint containers 12. The paint containers 12 include a locker ring 14, respectively, at one side of an upper opening portion 13.

In the multi-color paint application apparatus according to the present invention is formed a cover portion 20 that can open and close the upper side of the storage body 11 of the paint storage portion 10, in which a fixing board 22 which is bent to one side of the fixing body 22 is fixed on the upper surface of the cover portion 20 and fastening rings 21 are formed around the upper edge of the storage body 11, to thereby make the cover portion 20 fixed. The storage body 11 is sealed at a state where the edge of the cover portion 20 is pressed by making the fastening rings 21 rotated.

Discharge tubes 31 of a discharge portion 30 which discharges paint stored in the paint storage portion 10 are penetratively formed on the upper surface of the cover portion 20 and are communicated with the number of paint containers 12, respectively.

Auxiliary containers 32 are provided on the upper portion of the cover portion 20 and include a stopper 39 which is spirally sealingly closed at the upper side of the auxiliary containers 32 so as to put and store paints in the paint containers 12. Paint discharge valves 33 are fixed to the fixing board 22 at the outside of the auxiliary container 32 in which the paint discharge valves 33 are connected with the discharge tubes 31 through connection tubes 33'.

A sensor portion 40 which measures the levels of stored paints is formed in the discharge tubes 31 of the discharge portion 30.

The sensor portion 40 has sensors 41 which are respectively fixed to the discharge tubes 31 in the discharge portion 30 and whose contacts are short-circuited if a paint level is fallen in the paint containers 12. Here, a floater is formed in the paint containers 12, respectively, in which an alarm sound is produced by a buzzer if electric power is short-circuited.

An air inlet portion 50 makes compressed air flow into the paint storage portion 10 in order to discharge paint to a number of paint discharge valves 33 via a connection tube 33' which connects the discharge tubes 31 in the discharge portion 30 with the paint discharge valves 33 in which the discharge portion 30 communicates with the paint containers 12 where the sensors 41 of the sensor portion 40 are built in.

The air inlet portion 50 includes a 3-way valve 51 which makes pressure of air selectively flow into the center of the cover portion 20 so that compressed air flows into the paint storage portion 10.

A dehumidification portion 60 is formed in the 3-way valve 51 of the air inlet portion 50 in order to remove moisture from compressed air.

The dehumidification portion 60 is connected with an expansion tube 62 where a drain plug 61 that can remove moisture by adiabatic expansion of the compressed air in which a connection valve 64 where a pressure gauge 63 is formed is connected with the expansion tube 62.

A spray gun 70 is connected with the 3-way valve 51 in the air inlet portion 50 connected with the dehumidification portion 60.

A handle lever 72 of the spray gun 70 is connected with the 3-way valve 51 through a compressed air inlet tube 71, and a nozzle 74 of the spray gun 70 is connected with the paint discharge valves 33 of the discharge portion 30 through paint discharge tubes 73, respectively. Accordingly, the compressed air can be selectively sprayed through a switch 75 formed in the handle lever 72.

The nozzle 74 is connected with the respective paint discharge tubes 73 connected with the paint discharge valves 33, or is connected with a connector 76 which connects the paint discharge tubes 73 with a valve body 34.

Meanwhile, as shown in FIG. 4, a carriage unit 80 accommodates the body 11 of the paint storage portion 10 in the upper portion of the carriage unit 80, and is used to carry the body 11 of the paint storage portion 10. The carriage unit 80 includes: an accommodation body 81 that can accommodate the body 11 of the paint storage portion 10; a body grip 82 which is formed at both sides of the accommodation body 81; and a carrier caster 83 which is formed at the lower portion of the carriage unit 80. Accordingly a paint worker can carry the multi-color paint application apparatus indoor to work for painting.

In addition, as illustrated in FIG. 5, the paint discharge valves 33 in the discharge portion 30 includes: a stop ball 35 which is elasticity installed in a valve body 34 to properly control an amount of paint to be discharged; a control grip 36 which is inserted into the valve body 34 to then rotate so that the stop ball 35 is inserted into and withdrawn from a number of stop holes 37; and a control plate 38 in which the number of stop holes 37 are formed and which is located at the lower portion of the control grip 36. Accordingly, the amount of paint to be discharged is controlled by rotation of the control grip 36. The valve body 34 is fixed to the fixing board 22 formed in the cover portion 20.

As shown in FIG. 6, according to another embodiment of the discharge portion 30 of the present invention, a second discharge portion 30' having second paint discharge valves 33" communicate with the number of paint containers 12 which are located at the opposite side of the discharge portion 30 formed in the cover portion 20, respectively.

Thus, in order to further smoothly carry the multi-color paint application apparatus which has been formed as described above, a career 89 is provided as shown in FIG. 7. As shown, the carriage unit 80 which enables a user to carry the multi-color paint application apparatus according to the present invention and to perform a painting work, is loaded into the carrier 89. Accordingly, the carrier 89 is used when a user carries the multi-color paint application apparatus from indoors to outdoors, or he or she carries the multi-color paint application apparatus more conveniently.

In the carrier 89, a loading plate 85 is horizontally formed in a loading stand 84 so that a carrier caster 83 of the carriage unit 80 is inserted to thus load the accommodation body 81, a support rod 86 is formed in the lower-front end of the carriage unit 80, a moving wheel 87 is axially installed in the lower-rear end of the loading stand 84, and a moving handle 88 is installed at the upper-rear end of the carriage unit 80.

To employ the second discharge portion 30' of the multi-color paint application apparatus, as shown in FIGS. 8 to 13, the spray gun 70 connected with the second paint discharge valves 33" of the second discharge portion 30' includes: a second connector 701 which is formed at one side of the nozzle 74 of the spray gun 70; a combiner 702 which is formed at one side of the outside of the connection body 704 so as to communicate with the nozzle 74 by combining the connection body 704 with the second connector 701; and a connection path 703 is formed in the inner portion of the connection body 704.

A valve body 706 having a valve tube 705 is inserted into the connection path 703 of the connection body 704, and a rotary handle 707 is formed at the end of the valve body 706, in order to open and close the connection path 703 of the connection body 704. In addition, the second paint discharge valves 33" in the second discharge portion 30' and a second paint discharge tube 73' are connected with each other in order to supply each color paint by rotation of the valve body 706.

The function and effect of the multi-color paint application apparatus according to the present invention as constructed above will follow.

First, to get marble texture in an object to be painted, paints of desired colors are selected and the selected paints are accommodated in the paint containers 12 of the paint storage portion 10 by colors.

Under the circumstances, the upper portion of the storage body 11 of the paint storage portion 10 is closed by the cover portion 20, and then the fastening rings 21 formed in the edge of the storage body 11 are rotated to thus close or cover the paint storage portion 10 to then be sealed.

Reversely, the cover portion 20 is opened to fill in paints into the paint containers 12. However, in the case that paints of particular colors have been consumed, stoppers 39 of auxiliary containers 32 formed in the discharge portion 30 are made to rotate to be opened, so that paints consumed can be supplemented through the auxiliary containers 32, respectively.

If paints have been completely supplemented in the auxiliary containers 32, the storage body 11 is closed by the cover portion 20 to then be sealed, and the stoppers 39 formed in the auxiliary containers 32 are also spirally fitted with and tightly seal the upper portions of the auxiliary containers 32, respectively.

Then, the expansion tube 62 which is connected with the 3-way valve 51 that is formed in the cover portion 20 which tightly seals the storage body 11 is connected with a compressor (not shown) which generates compressed air for a connection valve 64 connected with the expansion tube 62, to thereby raise the inner pressure of the storage body 11 of the paint storage portion 10.

In addition, the nozzle 74 of the spray gun 70 is connected with the paint discharge valves 33 through the paint discharge tube 73, respectively, and the compressed air inlet tube 71 is connected with the handle lever 72 of the spray gun 70, so that multi-color paints can be sprayed by compressed air in operation of the switch 75.

The paint application apparatus having the above-described spray gun can spray multi-color paints simultaneously through a single spray gun. Accordingly, a paint worker can express marble texture of various colors conveniently.

Thus, each paint quantity should be controlled to express various kinds of marble texture.

According to a control method of controlling the paint quantity, the control grip 36 of each paint discharge valve 33 is rotated to control quantity of paints to be discharged through the valves. The control quantity is controlled by determining a control angle of the control grip 36 by a stop ball 35 which is repeatedly inserted into and withdrawn from stop holes 37 which are formed on a control plate 38.

In addition, according to another aspect of the present invention, the second paint discharge valves 33" connected with the paint containers 12 are connected with the connection body 704 through the second paint discharge tube 73' so that more color paints can be sprayed simultaneously and quantity of paint is minutely controlled.

The combiner 702 of the connection body 704 connected with the second paint discharge tube 73' is combined with the second connector 701 of the spray gun 70. Accordingly paints can be sprayed by the nozzle 74 of the spray gun 70 through the connection path 703 that is formed in the connection body 704.

The valve body 706 that is formed in the connection body 704 to open and close the connection path 703 is rotated through the rotary handle 707, to thus spray paints and simultaneously control an amount of paints, respectively. Thus, paints of various colors can be sprayed while moving be means of the carriage unit 80 or career 89.

To minutely control a paint quantity to be discharged, the valves for controlling the paint quantity should be easily controlled while performing a painting application work. For this reason, it is desirable to form the second connector 701 at the side of the nozzle 74 of the spray gun 70.

Meanwhile, in the case that any one of the connector 76 and the second connector 701 is employed, the connector 76 or the second connector 701 may be employed at a state where the connector 76 and the second connector 701 have been closed by a seal stopper 100 as shown in FIG. 12.

Marble texture that appears through the multi-color paint application apparatus can be expressed in various forms of marble texture through a spray gun by controlling an amount of sprayed paints as shown in FIGS. 14 to 18.

INDUSTRIAL APPLICABILITY

As described above, the present invention is applicable in a multi-color paint application apparatus which applies multi-color paints through a single spray gun in order to give texture of marble.

The invention claimed is:

1. A multi-color paint application apparatus comprising:

a paint storage portion having a number of paint containers in the inside of a storage body;

a cover portion that can open and close the upper side of the storage body of the paint storage portion, in which a fixing board which is bent to one side of a fixing body is fixed on the upper surface of the cover portion and fastening rings are formed around the upper edge of the storage body, to thereby make the storage body sealingly closed when the fastening rings are rotated;

a discharge portion which comprises discharge tubes which are penetratively formed on the upper surface of the cover portion and which are communicated with the number of paint containers, auxiliary containers which are provided on the upper portion of the discharge tubes and store respective paints discharged through the discharge tubes, and paint discharge valves that are fixed to the fixing board at the outside of the auxiliary container in which the paint discharge valves are connected with the discharge tubes through connection tubes;

a sensor portion having sensors which are respectively fixed to the discharge tubes in the discharge portion and including contacts that are short-circuited if a paint level is fallen in the paint containers, in which an alarm sound is produced by a buzzer if electric power is short-circuited;

an air inlet portion including a 3-way valve which makes pressure of air selectively flow into the center of the cover portion so that compressed air flows into the paint storage portion in order to discharge paint to a number of paint discharge valves via a connection tube which connects the discharge tubes of the discharge portion with the paint discharge valves in which the discharge portion communicates the paint containers where the sensors of the sensor portion are built in;

a dehumidification portion which is connected with an expansion tube where a drain plug that can remove moisture by adiabatic expansion of the compressed air is formed the 3-way valve in the air inlet portion, in which a connection valve where a pressure gauge is formed is connected with the expansion tube;

a spray gun which can selectively spray the compressed air through a switch formed in a handle lever, by connecting a compressed air inlet tube with the 3-way valve in the air inlet portion connected with the dehumidification portion to then be connected to the handle lever, and by connecting a nozzle and a connector with respective paint discharge tubes in the number of paint discharge valves a carriage unit which comprises an accommodation body that can accommodate the body of the paint storage portion in the upper portion of the carriage unit, a body grip which is formed at both sides of the accommodation body, and a carrier caster which is formed at the lower portion of the carriage unit.

2. The multi-color paint application apparatus according to claim 1, wherein the paint containers comprise a rocker ring, respectively, at one side of an upper opening portion.

3. The multi-color paint application apparatus according to claim 1, wherein the paint discharge valves in the discharge portion comprises: a stop ball which is elasticity installed in a valve body to properly control an amount of paint to be discharged; a control grip which is inserted into the valve body to then rotate so that the stop ball is inserted into and withdrawn from a number of stop holes; and a control plate in which the number of stop holes are formed and which is located at the lower portion of the control grip, and wherein the valve body is fixed to the fixing board formed in the cover portion.

4. The multi-color paint application apparatus according to claim 1, wherein a stopper is formed at the upper portion of the auxiliary containers in the discharge portion, respectively.

5. The multi-color paint application apparatus according to claim 1, further comprising a second discharge portion having second paint discharge valves which respectively communicate with the number of paint containers which are located at the opposite side of the discharge portion formed in the cover portion.

6. The multi-color paint application apparatus according to claim 1, further comprising a carrier in which a loading plate is horizontally formed in a loading stand so that a carrier caster of the carriage unit is inserted to thus load the accommodation body, a support rod is formed in the lower-front end of the carriage unit, a moving wheel is axially installed in the lower-rear end of the loading stand, and a moving handle is installed at the upper-rear end of the carriage unit.

7. The multi-color paint application apparatus according to claim 1, wherein a connection body is formed in and engaged with a second connector which is formed at one side of the nozzle of the spray gun, in which a combiner is formed at one side of the outside of the connection body and a connection path is formed in the inner portion of the connection body so as to communicate with the nozzle, a valve body having a valve tube is inserted in order to open and close the connection path, a rotary handle is formed at the end of the valve body, and the second paint discharge valves in the second discharge portion and a second paint discharge tube are connected with each other in order to supply each color paint by rotation of the valve body.

8. The multi-color paint application apparatus according to claim 5, wherein a connection body is formed in and engaged with a second connector which is formed at one side of the nozzle of the spray gun, in which a combiner is formed at one side of the outside of the connection body and a connection path is formed in the inner portion of the connection body so as to communicate with the nozzle, a valve body having a valve tube is inserted in order to open and close the connection path, a rotary handle is formed at the end of the valve body, and the second paint discharge valves in the second discharge portion and a second paint discharge tube are connected with each other in order to supply each color paint by rotation of the valve body.

* * * * *